United States Patent [19]

Prader

[11] 4,398,689

[45] Aug. 16, 1983

[54] APPARATUS FOR LOADING BAGS

[75] Inventor: Randolph D. Prader, Fairport, N.Y.

[73] Assignee: Mobil Oil Corporation, New York, N.Y.

[21] Appl. No.: 259,214

[22] Filed: Apr. 30, 1981

[51] Int. Cl.[3] ..... B64B 1/62

[52] U.S. Cl. ..... 248/99

[58] Field of Search ..... 248/99, 100, 95, 101, 248/98; 211/87, 106, 45; 248/302, DIG. 7

[56] References Cited

U.S. PATENT DOCUMENTS

| | | | |
|---|---|---|---|
| 142,286 | 8/1845 | Mayer | D44/1 |
| 245,134 | 7/1877 | Friedberg | D6/116 |
| 250,500 | 12/1878 | Marks | D6/85 |
| 251,944 | 5/1879 | Chasen | D6/114 |
| 461,291 | 10/1891 | Timmerman | 248/100 |
| 477,235 | 6/1892 | Timmerman | 248/99 |
| 810,329 | 1/1906 | Dyett | 248/99 |
| 989,642 | 4/1911 | Raw | 248/99 |
| 992,445 | 5/1911 | Parson | 248/99 |
| 1,351,094 | 8/1920 | Buckel | 248/99 |
| 1,653,393 | 12/1927 | Cox | 141/390 |
| 2,261,511 | 11/1941 | Baker et al. | 248/45 |
| 2,443,201 | 6/1948 | Sluyter | 267/1 |
| 2,557,674 | 6/1951 | McRae | 248/95 |
| 2,692,054 | 10/1954 | Berglund | 211/87 |
| 2,941,673 | 6/1960 | Lomas | 211/90 |
| 3,176,950 | 4/1965 | Hittesdorf | 224/42 X |
| 3,200,435 | 8/1965 | Hemmeter et al. | 16/137 |
| 3,255,484 | 6/1966 | MacDonald | 16/180 |
| 3,260,488 | 7/1966 | Kliewer | 248/99 |
| 3,506,233 | 4/1970 | Holben et al. | 248/358 |
| 3,658,284 | 4/1972 | Haasl | 248/145 |
| 3,838,839 | 10/1974 | Spencer | 248/99 |
| 3,905,406 | 6/1975 | Cruse | 141/390 |
| 3,973,376 | 8/1976 | Suominen | 53/385 |
| 4,062,170 | 12/1977 | Orem | 53/390 |
| 4,071,216 | 1/1978 | Einhorn | 248/290 |
| 4,175,602 | 11/1979 | Cavalaris et al. | 150/3 |
| 4,196,880 | 4/1980 | Hynes | 248/99 |
| 4,332,361 | 6/1982 | McClellan | 248/99 X |

FOREIGN PATENT DOCUMENTS

| | | | |
|---|---|---|---|
| 221765 | 10/1909 | Fed. Rep. of Germany | 248/99 |
| 89051 | 4/1937 | Sweden | 248/99 |

OTHER PUBLICATIONS

Advertisement—Marketote—Mobile Oil.

Advertisement—Roll and Rack—Extrufix Co., Ltd.

*Primary Examiner*—William E. Lyddane

*Assistant Examiner*—Sarah A. Lechok

*Attorney, Agent, or Firm*—C. A. Huggett; M. G. Gilman; J. F. Powers, Jr.

[57] ABSTRACT

The present invention provides a frame like structure easily attachable to a check-out counter in a grocery store environment. Handle arms are hingedly attached to the structure and perpendicularly project therefrom. The arms are further provided with a resilient tubular member which allows the arm when displaced with an applied force, to be returned to the perpendicular relationship. A support post is provided to hold a complement of plastic bags to the frame for ease in dispensing and filling the bags.

13 Claims, 5 Drawing Figures

APPARATUS FOR LOADING BAGS

BACKGROUND OF THE INVENTION

1. Field of the Invention

The present invention relates generally to an apparatus ofr the loading of grocery bags and, more particularly, pertains to a novel frame structure for the dispensing and loading of individual grocery bags in a grocery store environment.

2. Discussion of the Prior Art

A traditional and long-accepted method for packaging merchandise, such as groceries at the check-out counters of grocery stores, has involved the loading of individual paper bags, a process which is oftentimes inefficient, time-consuming and expensive. The person doing the bagging retrieves a bag from a stack, often under a counter, normally opens it by a quick motion of the arm causing air to catch in the bag and distend it, and then sets the bag upright on the counter. In the case of double bagging operations, a second bag must be opened in the same manner and then inserted inside the first bag to provide extra strength. The merchandise, e.g. groceries, is then placed into the open bag and the filled bags are slid across the counter so that the customers can put their arms around the middle of the bags and carry them out. Often, moisture absorption from the products contained within the heavily ladened bags will weaken the bottoms thereof, tending to cause them to separate or tear.

Although the general concept of packaging items in plastic bags is well known, prior art attempts to use such a concept to package merchandise in an environment such as, for example, that encountered at a modern grocery store check-out counter have, for the most part, met with little success. Thin plastic bags are very limp in nature and this characteristic not only adversely effects the loading operation, but any attempt to carry such a bag, loaded with groceries, at the mid-portion thereof proves to be very awkward because of the limp film's tendency to allow the upper portion of the bag to fold over, usually with disastrous consequences.

Recent attempts to remedy these deficiencies of plastic bags have included the provision on the bag of handles adjacent to the mouth of the bag. This has helped to alleviate the carrying problem, but the loading operation has remained a problem because of the difficulties attendant in loading a limp plastic bag which is not self-supporting. Elaborate devices have been used to open and support the empty bags, such as blowers which fill the bag with air and vacuum systems which hold the walls of the bag apart and upright, but these can be expensive, require substantial redesign and modification of check-out counters and are subject to mechanical breakdown in heavy use. Although semi-rigid plastic films, such as vinyl, high density polyethylene and high modulus laminar structures formed therefrom, are available and could be used to construct bags which are self-supporting, the cost of such material is far beyond the relative costs of paper packaging materials and therefore, although a potential solution, it is one which is economically unattractive.

However, in recent years, attempts have been made to provide an efficient loading apparatus which utilizes plastic bags having handles adjacent to the mouth thereof. Particularly, packaging systems have been designed to be incorporated into the check-out counter to provide greater ease of use to the operator. Normally, foodstuffs and articles purchased by consumers are placed onto the counter which may have a scanner capability for reading Universal Product Code markings. The typical packaging system has a large frame which shapes the plastic bags which are opened and suspended therein. The bag is supported by this structure during filling and can be removed, when full, relatively easily by the operator.

These attempts at providing an efficient apparatus for the loading of bags, although somewhat effective, have created problems in the packaging system art. Particularly, the structures which are to be incorporated into the check-out counter, require a relatively large amount of space to support each bag, thereby necessitating overly large counter tops. These counter tops make it extremely difficult for the operator to reach items purchased, for the scanning operation, because the operator must reach and bend over the partially full bags held within the large bag frames to grasp the items to be scanned. By extending over the bags the operator's body oftentimes strikes the counter top structure potentially causing slight injury and often causing great inconvenience to the check-out counter operator. It is these problems to which the present invention is directed.

None of the prior art, of which Orem U.S. Pat. No. 4,062,170 is typical, shows or even suggests the apparatus as described herein as a solution to the aforementioned problems.

As illustrated in Orem U.S. Pat. No. 4,062,170 an apparatus is provided for dispensing and holding individual plastic bags in an open position for loading. Support enclosures having a bottom and upstanding sidewalls, all of which are to be incorporated into the check-out counter, are provided to support all the sides of the plastic bag which is to be filled in a grocery environment. As stated previously, this patent teaches the use of a support apparatus which, although effective, is cumbersome to the operator.

Unlike the prior art, the present invention provides a wire frame structure which does not have to be incorporated into the check-out counter but on the contrary, can easily be attached to the ends or sides thereof. This provides much thinner, and consequently less costly, counters which minimize check-out costs while simultaneously maximizing store space. Further, the present invention provides a frame structure which has a resilient hinge member capable of swingingly moving in response to contact with the operator's body. By resiliently displacing the structure the operator can easily reach over the bags and easily grasp any items on the top of the counter because the frame will not cause injury as would be the case if the stationary structure shown in the prior art were attached to the counter top.

SUMMARY OF THE INVENTION

Accordingly, it is a primary objective of the present invention to provide a novel, improved apparatus for the inexpensive loading of a plastic bag in a grocery environment.

Another object of the present invention is to provide an apparatus which can easily be attached to the side or end of a check-out counter, thereby minimizing the width of the counter.

Still, a further object is to provide an apparatus which will not cause injury if the operator should accidentally, or intentionally, come into contact with the projecting portion of the apparatus.

The present invention provides a novel apparatus for the loading of bags by providing a wire frame which easily attaches to a counter, the frame having arms extending therefrom which are hingedly attached thereto. The arms maintain the bag disposed therebetween in an open position.

BRIEF DESCRIPTION OF THE DRAWINGS

The foregoing and objects, advantages and characterizing features of the inventive loading method and apparatus of the present invention will become clearly apparent from the ensuing detailed description of an illustrative embodiment thereof, taken together with the accompanying drawings wherein like reference numerals denote like parts throughout the views and in which.

DESCRIPTION OF THE PREFERRED EMBODIMENTS

Figure 1:
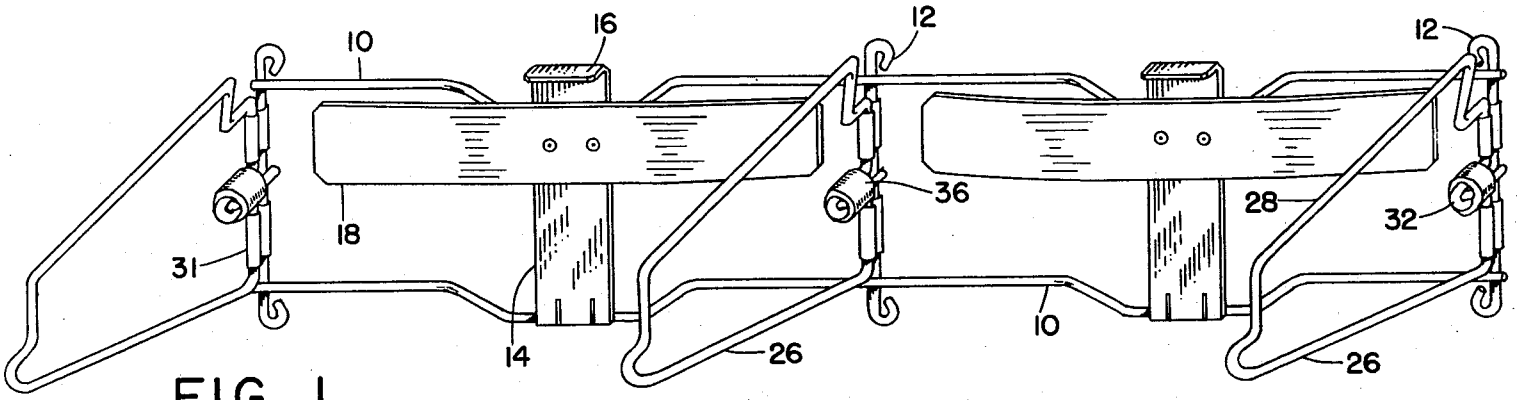
FIG. 1 is a front perspective view of the entire apparatus.
Figure 2:
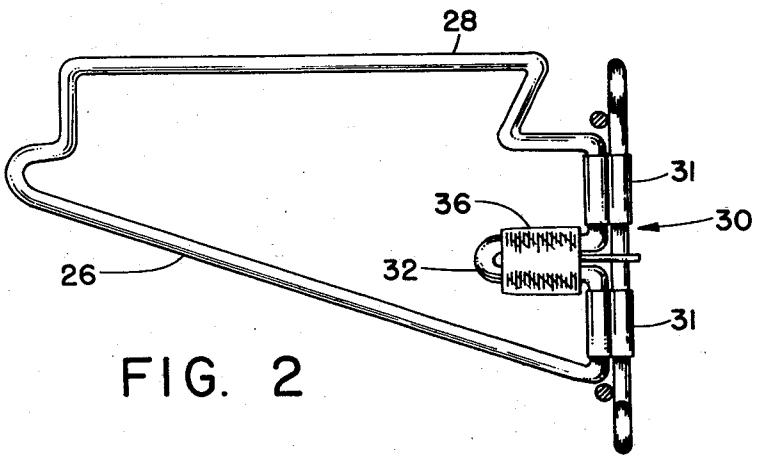
FIG. 2 is a side view, taken partially in cross-section of the handle arms.

Referring now in detail to the drawings, the present invention contemplates the use of a support frame 10 which can be fastened through the use of screws (not shown) and loops 12. It should be realized that in FIG. 1, two structures of the present invention are shown. It is, of course, contemplated that one, or any number, of structures is adequate to describe the present invention, and that two are shown as the preferred embodiment. The frame 10 is normally made of 3/16" diameter wire which is nickel chrome plated. A support post 14 is attached to said frame, normally by welding, and the post 14 is further provided with a tab 16 thereon. The support post 14 has a handle holder 18 riveted thereto. The handle holder 18 is preferably made of a flexible material, typically plastic, which more easily enables the check-out counter operator to drape the handles of the bags 20 over the holder 18.

Figure 5:
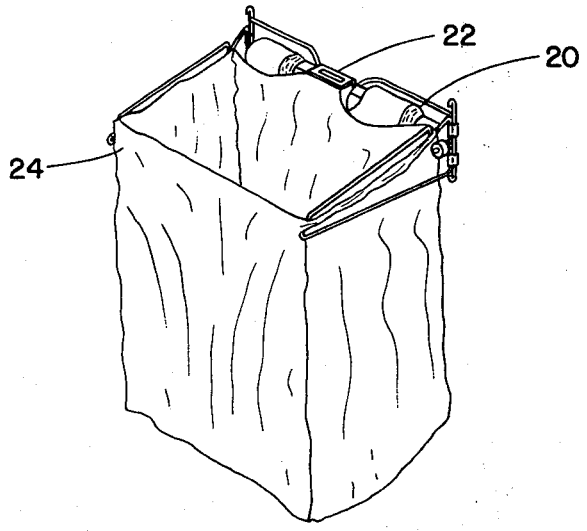
FIG. 5 is a front perspective view of the apparatus having bags therein.

As shown in FIG. 5, a stack of bags 20 is placed onto the tab 16. The stack of bags 20 is normally bound through the well-known process of heat welding with a slot formed in the stack 20 with a hot knife. The tab 16 projects through this slot at 22 thereby affixing the stack 20 to said frame 10. The handles are draped over the handle holder 18 and an individual bag 24 can then be easily stretched therefrom.

Figure 4:
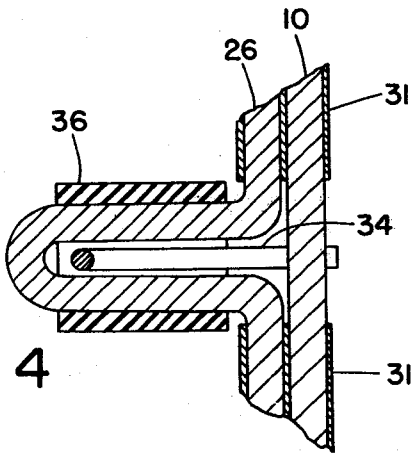
FIG. 4 is a side cross-sectional view of the hinging mechanism.
Figure 3:
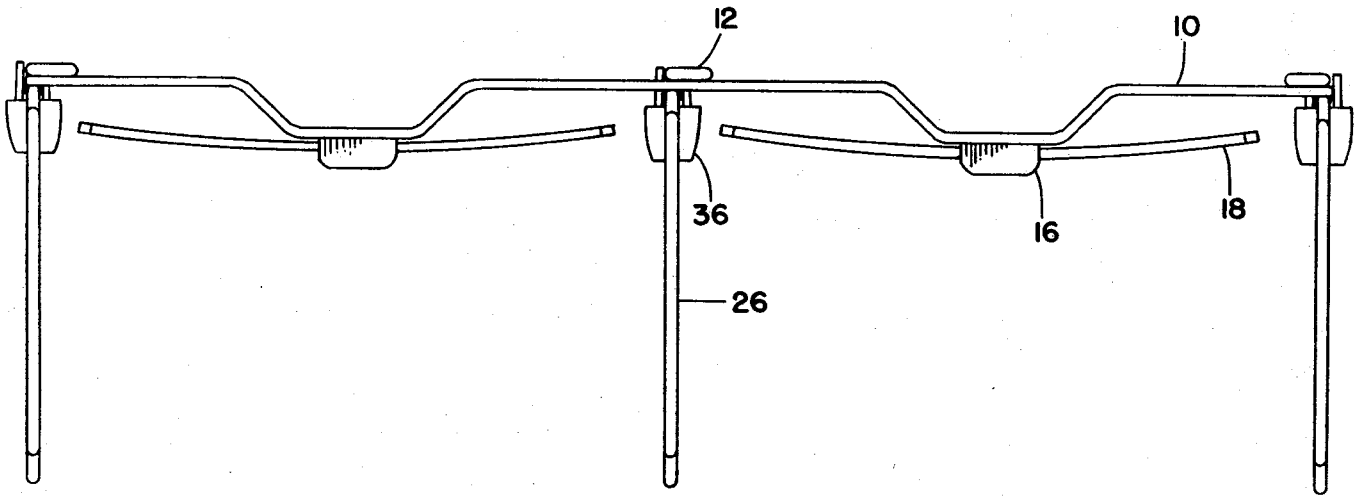
FIG. 3 is a top view of the entire apparatus.

Handle arms 26 are provided with a handle stretching segment 28 to stretch and extend the handles of the bag 24 which is to be filled. The arms 26 are attached at 30 to the support frame 10 and have an inwardly bent loop 32 therein. The loop 32 is integrally formed with the handle arm 26 and is in the same plane as that defined by arm 26. The loop 32, and hence arm 26, is hingedly attached 30 to the support frame by the use of a pair of hinges 31 which snap fit around the arm 26 and engagingly receive the frame 10. Normally, the hinges are spot welded to the frame 10 after press fitting around arms 26 thereby allowing the arms 26 to freely rotate within the hinge 32. As more clearly shown in FIG. 4, the frame 10 is further provided with a projection 34 which can be either in the form of a loop or a straight post. This projection is securely fastened to the frame 10 and, obviously, does not rotate relative thereto. It should be realized that if a loop is provided it must be constructed, as shown in FIG. 4, to be enveloped by the loop 32 of the arm 26, i.e. the loop 34 must have a smaller radius of curvature. Further, the loop 34 is preferably disposed in the plane perpendicular to the plane defined by the loop 32. A resilient tubular member 36 is placed over the loop 32 and projection 34 to effectively provide a resilient means for retaining the arm 26 in substantially perpendicular spaced relation to said frame 10. The tube 36 can be made of any resilient rubber, such as latex. The loops 32 and 34 may, and normally are, futher provided with tapered legs which will operate to further hold the resilient tube 36 thereon onto the loop configuration. This taper acts to retain the tube 36 onto the loops 32 and 34 even when the arm 26 is displaced from the perpendicular position.

In operation, the support frame 10 is fastened to a check-in counter by any well known attachment means. A complement of bags 20 is placed onto the tab 16 with the handles draped over the handle holder 18. When the check-out operator desires a bag, one bag is extended from the stack by grasping the handles thereof and stretching them over the handle stretching segment 28 of arms 26. Arms 26 extend perpendicularly from said frame 10 and are resiliently kept in such a spaced relation through the operation and use of hinge mechanism 30. The plastic bag is thereby kept in an open posture, ready for receiving said grocery items. As a result thereof, a check-out operator who comes into contact with said handle arms 26, through the force exerted thereby, can easily displace said arm 26 from its original axis. However, upon release of such force, the tubular member 36 forces the arm 26 to resiliently swing back to its original perpendicular orientation thereby effectively preventing any potential injury to the operator and creating a simple and efficient apparatus for the loading of bags in a grocery environment.

From the foregoing, it is apparent that the objects of the present invention have been fully accomplished. As a result of the present invention, a novel apparatus for the loading of bags has been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. An apparatus for the loading of bags comprising:

a. a support frame;

b. means for retaining a stack of bags in spaced relation to said support frame; said stack retaining means including a support post having an end tab thereon, said post being tansversely affixed to said frame and a handle holder affixed to said post and said frame;

c. handle arms extending from, and hingedly attached to, said support frame; and means for retaining said handle arms in a substantially perpendicular spaced relation to said support frame.

2. An apparatus as claimed in claim 1, said handle holder comprised of a generally rectangular configuration transversely extending in relation to said post and longitudinally extending in relation to said frame.

3. An apparatus as claimed in claim 1, said handle holder comprised of a flexible material.

4. An apparatus according to claim 1, said support frame comprised of 3/16" steel wire.

5. An apparatus according to claim 4, said support frame, said arm handles, and said projection being nickel chrome plated.

6. An apparatus for the loading of bags comprising:

a. a support frame;

b. means for retaining a stack of bags in spaced relation to said support frame;

c. handle arms including a handle stretching segment and an integrally formed inwardly bent loop extending from and hingedly attached to said support frame; and d. means engaging said loop for retaining said handle arms in a substantially perpendicular spaced relation to said support frame.

7. An apparatus as claimed in claim 6, said handle arms comprising tubular steel forming a wire frame thereof, said inwardly bent loop further comprising a loop formed from said steel wire, said loop having legs extending in a straight configuration.

8. An apparatus as claimed in claim 6, said handle arms comprising tubular steel forming a wire frame with said inwardly bent loop, said loop further formed from said steel wire having legs extending therefrom in a tapered configuration.

9. An apparatus as claimed in claim 6, said handle arms hingedly attached to said support frame comprising a pair of hinges which snugly fit around the handle arm frame and engagingly receive said support frame whereby the handle arm is allowed to rotate within the hinge and, concurrently, said hinge is fastened to said support frame.

10. An apparatus for the loading of bags comprising:

a. a support frame;

b. means for retaining a stack of bags in spaced relation to said support frame;

c. handle arms extending from and attached by hinges to said support frame; and d. means for retaining said handle arms in a substantially perpendicular spaced relation to said support frame; said means for retaining said arms in substantially perpendicular spaced relation to said support frame comprising a projection fixedly attached to said support frame and interposed between said hinges, said projection extending into a loop formed by said handle arm so as to be enveloped thereby, and a resilient tubular member positioned thereon so as to circumscribe said loop at said handle arm and the projection enveloped therein.

11. An apparatus as claimed in claim 10, said projection comprised of a straight post.

12. An apparatus as claimed in claim 10, said projection comprised of a loop having a smaller radius of curvature than the loop formed in the arm handle, said projecting loop having straight legs and said loop perpendicularly disposed to the arm handle loop.

13. An apparatus according to claim 10, said resilient tubular member comprised of latex rubber.

* * * * *